United States Patent [19]

Bao

[11] Patent Number: 4,665,761

[45] Date of Patent: May 19, 1987

[54] LONG STROKE PUMPING UNIT

[75] Inventor: Zheng-Yi Bao, Hebei, China

[73] Assignee: North China Petroleum Machinery Repairing Plant, Hebei, China

[21] Appl. No.: 713,680

[22] Filed: Mar. 19, 1985

[51] Int. Cl.[4] ..... F04B 47/02

[52] U.S. Cl. ..... 74/41; 74/89.2

[58] Field of Search ..... 74/41, 89.2, 89.21, 74/89.22, 108

[56] References Cited

U.S. PATENT DOCUMENTS

| | | | |
|---|---|---|---|
| 2,502,057 | 3/1950 | Mitchell | 74/41 |
| 2,681,623 | 6/1954 | Kane | 74/108 |
| 2,683,424 | 7/1954 | Kane | 74/108 |
| 3,153,387 | 10/1964 | Sadouet | 74/41 |
| 4,121,471 | 10/1978 | Chancellor | 74/41 |
| 4,161,137 | 7/1979 | Gaddy | 74/41 |
| 4,275,609 | 6/1981 | DeLaney | 74/41 |
| 4,404,870 | 9/1983 | Atumaru | 74/833 |
| 4,483,208 | 11/1984 | Parker | 74/41 |
| 4,519,262 | 5/1985 | Le et al. | 74/89.2 |

FOREIGN PATENT DOCUMENTS

| | | | |
|---|---|---|---|
| 802608 | 2/1981 | U.S.S.R. | 74/41 |

*Primary Examiner*—Lawrence Staab

*Attorney, Agent, or Firm*—Pennie & Edmonds

[57] ABSTRACT

A long stroke pumping unit comprising a tower mounted on a base and a counterweight-polished rod system which bestrides a top wheel mounted on the top of said tower, employs an electric motor as its prime mover. The motor rotates in a fixed direction, and through a crank mechanism the rotation of electric motor is turned into a linear reciprocating movement which is in an approximately simple harmonic fashion, and then, by means consisting of fixed pulley blocks and a travelling pulley block assembly the stroke of said reciprocating movement is multiplied and transmitted to the counterweight-polished rod system. The stroke can be easily changed by changing the effective length of the crank, also, it can be selected within a great extent by changing the number of pulleys engaged in operation.

14 Claims, 13 Drawing Figures

LONG STROKE PUMPING UNIT

BACKGROUND OF THE INVENTION

This invention relates generally to well pumping units and more particularly to pumping units without walking beams. This invention employs an electric motor as its prime mover. A pair of crank mechanism symmetrically situated near the outside of the lower portion of a tower is used to generate a linear reciprocating movement in an approximately simple harmonic fashion. The distance of such movement is multiplied by multiplying means consisting of an assembly of fixed pulley blocks and a traveling pulley block. The degree of movement depends upon the number of pulleys in each pulley block. The movement is then transmitted to a counterweight-polished rod system connected to the multiplying means, making the polished rod reciprocate in a long distance, with approximately simple harmonic fashion. The effective length of the crank can be easily adjusted to obtain a required stroke. Also, by changing the number of pulleys operating in the multiplying means, the stroke distance can be changed to a greater extent. The stroke rate is changed by changing the motor speed or changing the transmitting ratio between the electric motor and the gear reducer.

A review of prior art will be helpful to the understanding and evaluation of this invention before a detailed description is given. At present, pumping units are widely used for lifting oil from those wells which are not gushers. As the liquid level in the well becomes lower as the time as production goes on, or as the need to lift oil therefrom deeper wells arises, a greater depth of plunger is required. This results in some problems, the first of which is a lower pump efficiency. Since the metal sucker rod is elastic, it will be stretched and the load applied on it, resulting in a stroke loss. The greater the depth of plunger, the greater the stroke loss will be, meaning a lower pump efficiency. If the stroke of a pumping unit is longer, however, the relative stroke loss is less, so it is favourable to use a long stroke pumping unit in such cases. Long stroke pumping units are especially good for wells producing oil of high viscosity or of high water-oil ratio. For a certain production rate, a longer stroke distance means a lower stroke rate, consequently a lower speed and a lower acceleration, thus providing various advantages and benefits. For example, a longer fatigue life of the sucker rod is provided because it experiences reduced cycles of stresses of variable amplitude. Another benefit is the reduced wear of the plunger and tubing because of the lower speed and acceleration of operation and the greater area over which the wear is distributed. In brief, A longer stroke makes a higher pump efficiency and a longer service life of various parts.

Long stroke pumping units can be classified into two types by their designs, i.e., walking beam pumping units and pumping units without walking beams. A walking beam long stroke pumping units is shown in U.S. Pat. No. 4,306,463, comprising a walking beam pivotally mounted for free swinging motion on a Sampson post. The walking beam includes a fixed counterweight mounted on one end and a horsehead mounted on the opposite end. A polished rod is connected to the horsehead through a wire rope. The walking beam is driven by an electric motor or by hydraulic means in an up and down pumping motion, making the polished rod move up and down. The shortcomings of walking beam pumping units are the cumbersome structure, heavier weight, greater base requirement and existence of centrifugal force generated by the rotating counterweights.

A typical long stroke pumping unit without walking beam includes an upright tower with a rotatable drum mounted on its top. A wire rope or a belt winds around the drum with the polished rod connected to it on one end and the counterweight connected to the opposite end. A winch driven by an electric motor or a hydraulic motor moves, directly or indirectly, the polished rod. Motion of the polished rod may be reversed by reversing the electric or hydraulic motor. The deceleration, or dampening, of motion near the termination of the stroke is realized electrically or hydraulically.

U.S. Pat. No. 3,285,081 shows one kind of long stroke pumping unit without walking beams. It comprises a tower with a drum mounted on its top, a counterweight and a rod string suspended from said drum but moving in opposite directions. A driving system comprising a reversible electric motor and a gear reducer and a wire rope connecting the output shaft of the gear reducer and the drum makes the drum rotate in alternative directions. The stroke distance of the pumping unit depends on revolutions of the electric motor during the stroke. The motion reversal of the polished rod and the deceleration and dampening upon reversal of the motion may be accomplished by reversing, stopping, and starting the electric motor electro-mechanically.

For other prior arts related to this invention, also see U.S. Pat. Nos. 3,538,777. 3,695,117, 3,771,609, 4,052,907, 4,062,640, 4,388,837, 4,391,155.

SUMMARY OF THE INVENTION

An object of this invention to contribute a completely new long stroke pumping unit without walking beam, which is simple in structure, convenient to operate, easy to maintain, low in cost, reliable in operation and which requires a minimum base. This invention comprises a base, an upright tower mounted on the base, a rotatable top wheel surmounting the tower, a counterweight assembly and polished rod interconnected by a wire rope bestriding the top wheel at opposite sides, i.e. the front side and the rear side of the top wheel. This new type of long stroke pumping unit employs a multispeed electric motor as its prime mover which rotates in a fixed direction. The long stroke reciprocating movement of the polished rod, which moves in an approximately simple harmonic fashion, is realized through completely mechanical means. Said mechanical means comprises two assemblies. One of which is a pair of crank mechanisms driven by an electric motor-gear reducer system mounted on the base at the bottom of the tower. The function of said crank mechanisms is to generate a reciprocating movement in approximately simple harmonic fashion. Then the movement is transmitted to a stroke-multiplying means. The stroke-multiplying means comprises fixed pulley blocks and a travelling pulley block assembly all located inside the tower, and a wire rope wound round these pulleys in a certain manner. The reciprocating movement generated by the crank mechanisms is then multiplied by the stroke-multiplying means. Said means is capable of transmitting power bi-directionally. The multiplied reciprocating movement is then transmitted to the counterweight-polished rod system disposed at opposite sides of the top wheel on the top of the tower to make the polished rod more up and down. The stroke distance can be changed by changing the effective lengths of the cranks and also, to a greater extent, by changing the number of pulleys engaged in operation in each pulley block.

Another object of this invention is to provide a set of fail safe device for the long stroke pumping unit manufactured by this invention, which responds upon failure of certain parts of the pumping unit to protect the whole pumping unit. Said fail safe mechanism will activate immediately upon failure of the polished rod or the wire rope connecting the counterweight assembly and the polished rod by preventing the counterweight assembly from falling down due to its own weight. At the same time, the power supply is cut off in order to stop the pumping unit, thereby preventing further damage. Furthermore, in order to protect the pumping unit from being damaged, the mechanism immediately cuts off the power supply in the event of failure or excessive slackness of the wire rope in the stroke-multiplying means.

A yet another object of this invention is to provide a tensioner for said long stroke pumping unit in this invention, which is capable of keeping the wire rope in the stroke-multiplying means always in tension. This is to ensure the reliable multiplying of the reciprocating movements which is generated by the crank mechanisms and approximately simple harmonic motion, and transmitting this movement in opposite directions.

It is a further object of this invention to provide a wire rope-clamping device for said long stroke pumping unit in this invention, which is mounted on a carrier and capable of clamping tightly a certain portion of the wire rope in the stroke-multiplying means to ensure that the polished rod moves up and down exactly in an approximately simple harmonic fashion generated by the mechanisms mentioned above.

BRIEF DESCRIPTION OF THE DRAWINGS

An embodiment of this invention is shown in the accompanying drawings, in which.

DESCRIPTION OF THE PREFERRED EMBODIMENT

Figure 1:
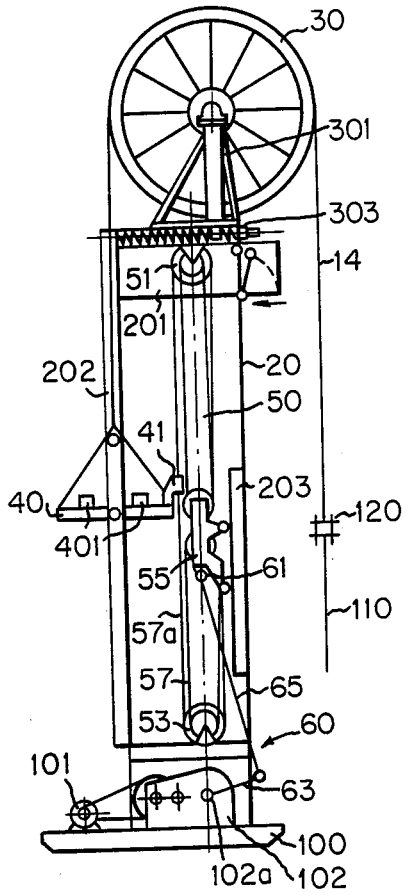
FIG. 1 is a schematic side view of a long pumping unit according to this invention.

Referring now to the drawings by reference numerals and in particular to FIG. 1 thereof, a multi-speed electric motor (101) is mounted on a base (100) of the long stroke pumping unit. A gear reducer (102) with its output shaft stretching out from both sides is driven by the electric motor through a belt. A tower (20) is mounted vertically on a base (100). Gear reducer (102), including a brake system, is located on the base at the bottom of the tower with its output shaft stretching out from both sides of the lower portion of the tower. Said tower (20) is an elongated space frame and is weld fabricated of four parts and a number of braces. An operating platform (201) for servicemen, equipped with railing, is mounted adjacent to the top of the tower and surrounds the tower except for the rear side, its front part can be turned upward to make way for well servicing operation. On two-sides of the tower, there are two ladders extending to the top of the tower. A rotatable top wheel (30) is mounted on the top of said tower. Counterweights (401) are placed in a carrier (40) which is movable up and down along rear tracks (202) mounted on the rear posts of the tower. The carrier is connected by a wire rope (14) bestriding said top wheel with a suspension joint (120) and a polished rod (110) at the front side of the tower to form a balanced system. Counterweights of different weights are available for different combinations as required. The principle of determining the weight of counterweight assembly is such that the total weight suspended from the rear end of the wire rope is somewhat greater than that suspended from the front end of the wire rope by a preferable difference of one half weight of the oil column, that is, the total weight of the carrier and the counteweights should be greater by one half weight of the oil column than the total weight of the suspension joint (120) and the polished (110) in oil.

An adjusting screw (303) used to move said top wheel forth or back is installed on the bottom of a support (301) of top wheel (30).

A stroke-multiplying means (50) comprising an upper fixed pulley block (51) and a lower fixed pulley block (53) and a travelling pulley block assembly (55) is installed inside the tower between the top and bottom thereof. These three pulley blocks are associated with each other by a wire rope (57) in a certain manner. The travelling pulley block assembly is connected with an over arm (61) of a crank mechanism (60). Two cranks parallel to each other are respectively mounted on two ends of the output shaft of the gear reducer. Two connecting rods (65) are hinged at one end to the cranks respectively and, at the other end, hinged respectively to two ends of said over arm (61) protruding respectively from two rectangular openings on two sides of the tower. Rollers (559) are mounted on a frame (551) of the travelling pulley block assembly, enabling the travelling pulley block assembly moving up and down along a front tracks (203) mounted on the tower. A clamping device (41) mounted on the carrier clamps wire rope (57) at a certain position (**57*a***) between said fixed upper and lower pulley blocks, thus carrying the polished rod to move up and down while the electric motor rotates in a fixed direction. The stroke rate can be changed by changing either motor speed or transmitting ratio between the electric motor and the gear reducer. Stroke distance can be changed by changing the effective lengths of cranks (63). Furthermore, changing the number of pulleys composing the pulley blocks or pulleys engaged in operation in the pulley blocks the stroke distance can be changed to a greater extent. It is recommended to put the cranks in a vertical position when starting the pumping unit.

Figure 2:
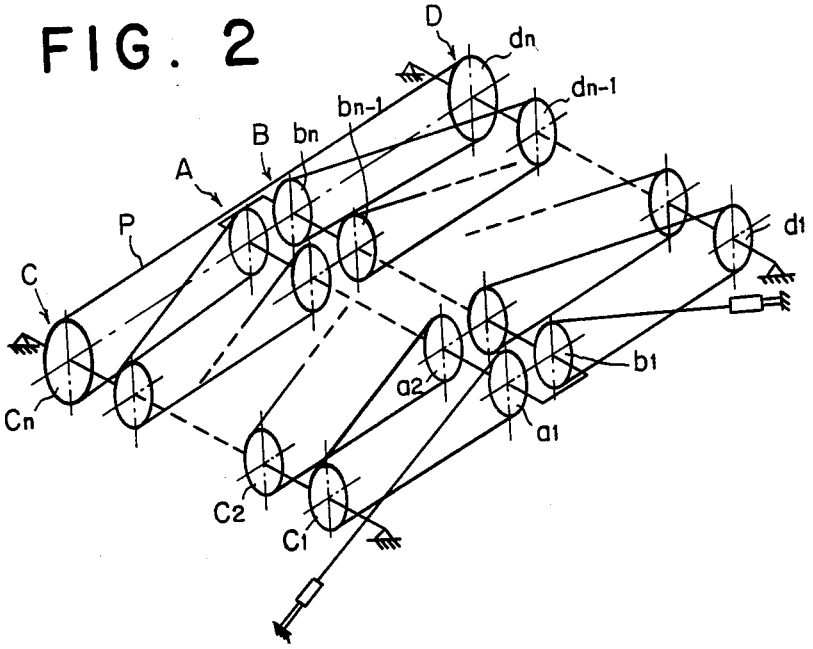
FIG. 2 shows the principle of the stroke-multiplying means used in this invention.

FIG. 2 is a schematic drawing of the stroke-multiplying means consisting of pulley blocks. There are four pulley blocks (A,B,C and D), each having equal number of pulleys wherein (C) and (D) are fixed pulley blocks, (A) and (B) are travelling pulley blocks which are rigidly interconnected by a frame and movable between (C) and (D). The axes of all pulleys are parallel to each other.

A wire rope (57) is used to connect these pulley blocks together in a manner as follows: Let one end of the wire rope fixed and guide the free end to wind round pulley ($a_1$) in block (A), then to wind round pulley ($c_1$) in block (C), guide the free end to turn back and to wind round pulley ($a_2$) in block (A), then guide the free end to turn back to block (C) to wind round pulley ($c_2$) in block (C), Do in this way until the free end winds round the last pulley ($c_n$) in block (C). Then guide the free end to fixed pulley block (D), winding round pulley ($d_n$), then to pulley block (B), winding round pulley ($b_n$), then back to block (D), winding round pulley ($d_{n-1}$). Do in this way until the free end has wound round the last pulley ($b_1$) in block (B). Then tighten the wire rope and fix its free end. When doing this, sections of the wire rope should not be crossed over each other to reduce frictional resistance and wear. Obviously, in this means consisting of pulleys, when travelling pulley blocks (A) and (B) move together by a distance ($S_o$) in a certain direction, say, to the right, then the total increase in length of the sections of wire rope between block (A) and block (C) is ($2nS_o$), while the total decrease in length of the sections of wire rope between (B) and (D) is exactly ($2nS_o$). That is, the length paid out by the sections of the wire rope between block (B) and block (D) is just got in by the sections of the wire rope between block (A) and block (C). Conversely, when travelling pulley blocks (A) and (B) move together to the left by a certain distance ($S_o$), the total variation in length of the sections of the wire rope between block (A) and block (C) or that of the wire rope between block (B) and block (D) are also ($2nS_o$). The only difference is that there is a decrease in length of the wire rope between block (A) and block (C) but an increase in length of the wire rope between block (B) and block (D). So when travelling blocks move a distance ($S_o$), the displacement (S) of any point (K) in section (P) of the wire rope between block (C) and block (D), more exactly, between pulley ($c_n$) and pulley ($d_n$), is (2n) times as many as ($S_o$), that is ($S=2nS_o$). Obviously, if a movable object is carried by section (P) of the wire rope at a point (K) thereof in section (P), then the displacement of this object is also (2n) times as many as ($S_o$). Thus we obtain a stroke-multiplying means which is capable of multiplying the input linear displacement by (2n) times. An important feature of such a multiplying means is that it is capable of transmitting power in opposite directions, as opposed to an ordinary mechanism with a wire rope as the force-transmitting element, which can only transmit power in one direction.

Figure 3:
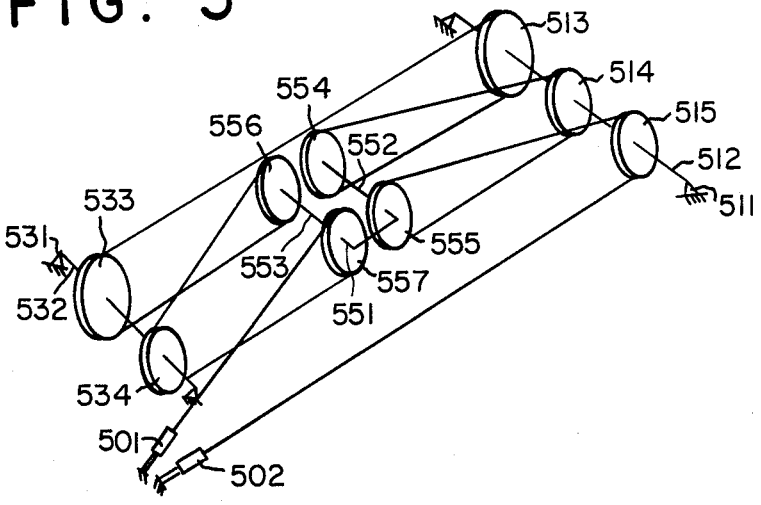
FIG. 3 shows on arrangement of the stroke-multiplying means of the preferred embodiment of this invention.
Figure 12:
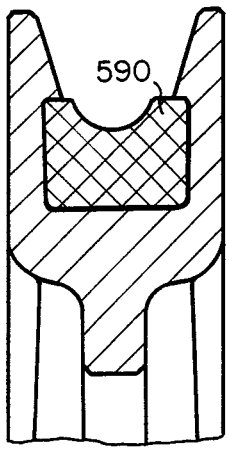
FIG. 12 shows the detailed groove structure of pulleys employed in the stroke-multiplying means.
Figure 13:
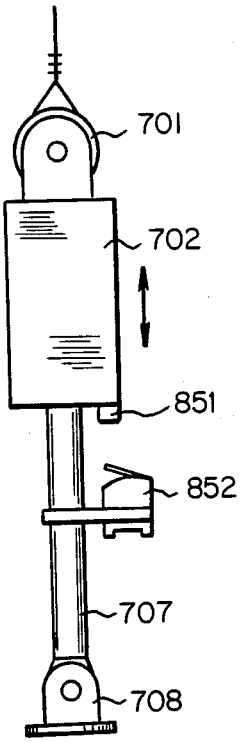
FIG. 13 shows the safety device attached to the stroke-multiplying means.

FIG. 3 is a schematic drawing showing one of the arrangements of pulley blocks in the stroke-multiplying means employed by the long stroke pumping unit in this invention. In this embodiment, there are two pulleys engaged in operation in each pulley block, obtaining a multiple of 4. A lower pulley block (53) mounted inside the tower and above the gear reducer includes a support (531) by which the lower pulley block is fixed on the tower and two pulleys (533,534) mounted on a shaft (532) on the support. Pulley (533) and pulley (534) are rotatable independently, the larger one of which (533) is generally in the central plane of the tower while the smaller one of which (534) is offset. An upper pulley block (51) is mounted by a support (511) beneath the top of the tower. Two pulleys (513) and (514) and a guide wheel mounted on a shaft (512) on the support are all rotatable independently on the shaft. Pulley (513) is greater in diameter than others, but equal to pulley (533) in the lower pulley block (53) and is generally in the central plane of the tower. The other one (514) is offset and equal in diameter to pulley (534). Guide wheel (515) is located at the outer side of pulley (514). A travelling pulley block assembly (55) which can reciprocate along front tracks (203) on the tower between the fixed upper and lower pulley blocks has a frame (551), two shafts (552) and (553) parallel to each other, on each of which are mounted two pulleys (554,555) and (556,557) rotatable independently which are equal in diameter to those smaller pulleys (514) and (534) in the fixed pulley blocks. Pulleys (554) and (555) on shaft (552) are generally aligned with those two pulleys (513) and (514) in the fixed upper pulley block respectively, while pulleys (566) and (557) on shaft (553) are generally aligned with those two pulleys (533) and (534) in the fixed lower pulley block respectively. These four shafts (512, 532, 552, 553) are parallel to, and in the same plane with the output shaft of gear reducer (102). A wire rope (57) is secured on its one end to the base through a tensioner (501) and is wound excessively on the other end around all pulleys (557, 534, 556, 533, 513, 554, 514, 555) in the means in a manner described above and then secured to the tower through another tensioner (502). The reason that pulley (513) and pulley (533) are larger in diameter is to prevent different sections of the wire rope from rubbing each other and to provide an adequate space for installing the clamping device. A number of rollers are mounted on the frame (551) of the travelling pulley block assembly so as to guide said assembly. Frame (551) is connected to an overarm (61) through a ball joint. A ring of oil-resistant rubber is embedded in the groove of each pulley, as shown in FIG. 12, to reduce wear and noise.

Figure 4:
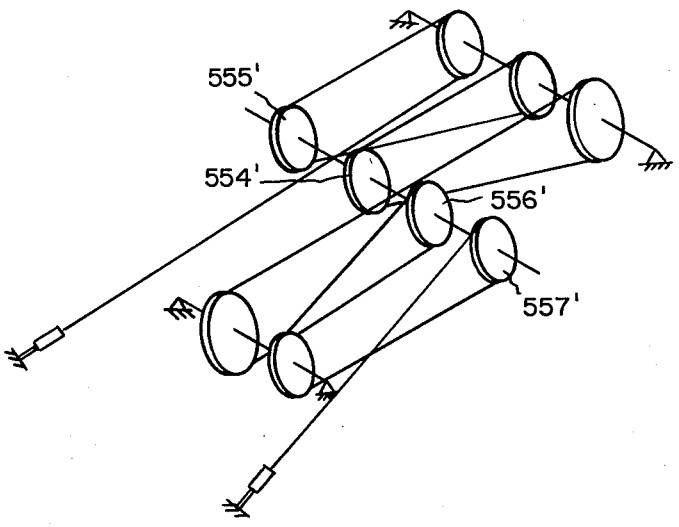
FIG. 4 shows another arrangement of the stroke-multiplying means of the preferred embodiment of this invention.

In FIG. 4 another recommendable arrangement of pulleys of said blocks is shown. This arrangement is the same as that described above except for a different arrangement of pulleys in the travelling pulley block assembly described above (shown in FIG. 3), so identical reference characters are used. In this plan, four pulleys (554', 555', 556', 557') of equal diameter in the travelling pulley block assembly are coaxial and rotatable independently and aligned with those pulleys in fixed pulley blocks respectively. The manner in which the wire rope is wound is the same. There are, of course, other choices for the arrangement of pulleys in pulley blocks, but no one can be beyond the scope of this invention.

Figure 5:
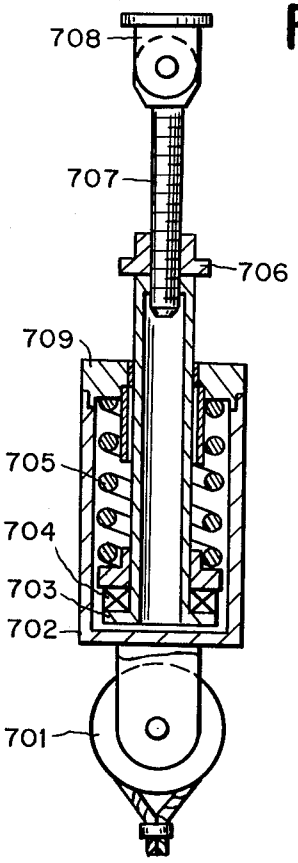
FIG. 5 is the schematic drawing of a tensioner.

A tensioner (501, 501), as shown in FIG. 5, capable of keeping the wire rope (57) always tense and shock-absorbent shock is included in the stroke-multiplying means and comprises a pulley (701), a sleeve (702), a hollow pull rod (703), a thrust bearing (704), a compression spring (705), a locking nut (706), an adjusting screw (707), a support (708) and a cap (709).

Sleeve (702) is a cylindrical body having a bore closed at one end and an ear-like pedestal extending outwardly along its axis from the closed end and an inner thread at the open end. Hollow pull (703) is an elongate hollow member with a flange slidable in the bore of said sleeve (702) at one end and an inner thread at the other end. Pulley (701) is pivotally connected to the ear-like pedestal of said sleeve (702). The end of rod (703) with a flange is put into sleeve (702) while the other end protruding from a coaxial hole in cap (709) is connected through the thread at the end with adjusting screw (707) hinged to support (708). Thrust bearing (704) and compression a spring (705) are inside the sleeve (702) and the sleeve is over after rod (703) with one end of the thrust bearing (704) against the flange and the other end against the compression spring (705). The other end of the compression spring (705) is against the interior end face of the cap (709). One end portion of the wire rope in the stroke-multiplying means winds round the pulley (701) and is secured. The support (708) is fixed on the base or the tower. The wire rope can be pretensioned by the turning rod (703) and then locking the rod by locking the nut (706).

A pair of crank mechanisms located symmetrically at two sides of the lower portion of the tower are coupled by keys with the output shaft of the gear reducer and is moved respectively in two planes parallel to the central plane of the tower. Each crank mechanism has a crank and a connecting rod. Each end of the overarm (61) is pivotally connected with a connecting rod. In each crank (63) there is a mounting hole adjacent to its one end through which the crank is mounted on the output shaft of the gear reducer. Torque is transmitted from the output shaft of the gear reducer to cranks by means of keys. These two cranks keep parallel to each other at all times of rotation. There is a row of holes in each crank at the opposite portion to the mounting hole for selection of the effective length of the crank, i.e. the stroke of the polished rod. The axes of these holes and the axis of the mounting hole are parallel to each other and are all in the central plane of symmetry of the crank. The connecting rod (65) is an elongate rod with circular cross section and two borings made on its enlarged ends respectively. The axes of said borings are perpendicular to each other. The overarm (61) is an elongate structure with rectangular cross section fabricated of sheet steel. In the middle of said overarm, a holder protrude upward therefrom and through it the overarm is connected by a ball joint with the frame of the travelling pulley block assembly. Both ends of the overarm protrude from two rectangular openings on the opposite sides of the tower. There is a U-shaped opening on each end face of said overarm symmetrical to the center thereof and a lateral boring through the wall of the opening. One end of the connecting rod (65) extends into a corresponding opening of said overarm and rotatably mounted on a pin fixed between walls of the opening while the other end is connected through a pin with a certain hole of the crank.

Figure 6:
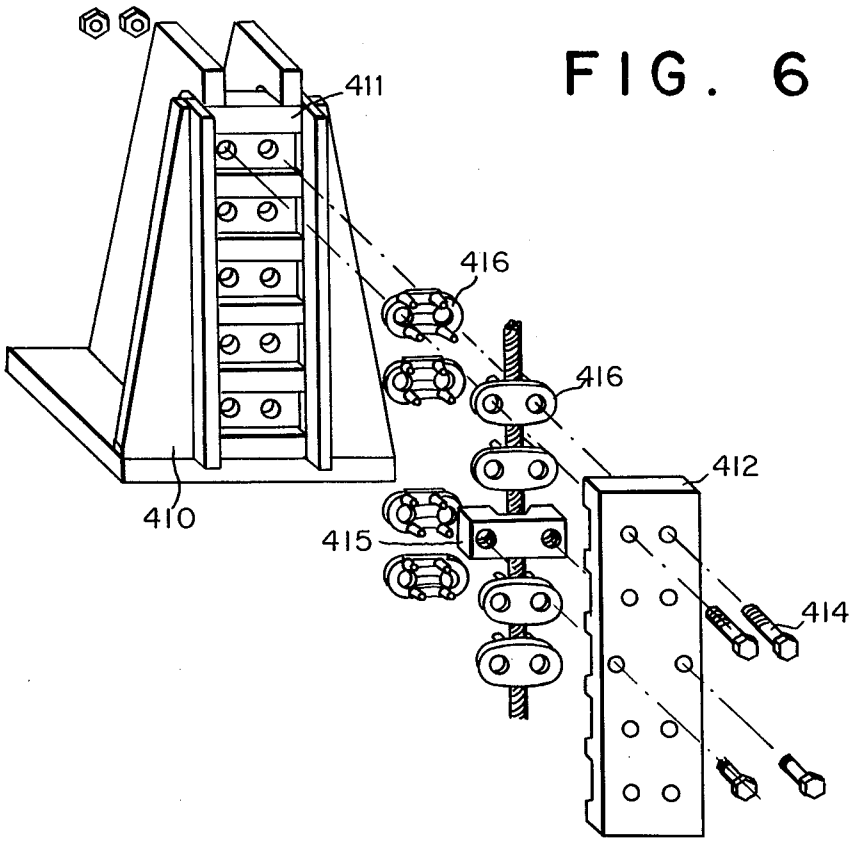
FIG. 6 is the perspective drawing of clamping device.

The stroke-multiplying means the counterweight-polished rod system are interconnected by a clamping device. The clamping device, as shown in FIG. 6, includes a support (410), two clamping plates, one of which (411) is fixed on the support (410) while the other one (412) is attached to the fixed clamping plate (411) by bolts. Key (415) embedded in clamping plates are used to take the vertical shear force. Several toothed discs (416) are embedded in the facing surfaces of two clamping plates respectively with the teeth thereon facing each other. The trend to said teeth are in correspondence with the strand direction of the wire rope. The support (410) is fixed on the carrier (40) by bolts. The section (P) of the wire rope mentioned before in the stroke-multiplying means passes between the toothed discs on two clamping plates. By tightening up bolts (414), the wire rope and the support and the carrier are connected together. Thus, when starting the motor, movement will be transferred to the counterweight-polished rod system.

Figure 7:
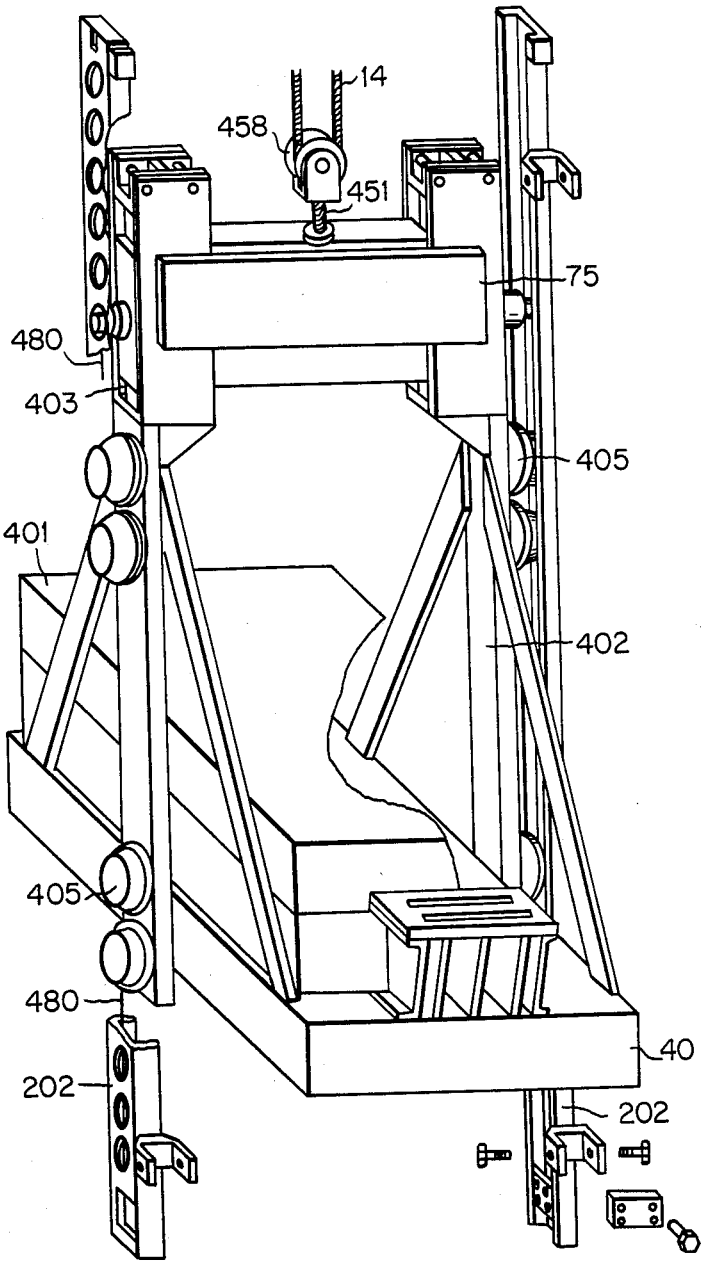
FIG. 7 shows the carrier together with a safety device.

The counterweight assembly as shown in FIG. 7 comprises a carrier (40), a fail safe device (45) and counterweights placed in the carrier. The carrier is a box with its top side open and has two posts (402) standing upright in the middle of two sides respectively. There is a rectangular opening in the enlarged portion at the top of each post. Rollers (405) extending into rear tracks (202) are attached to the side walls of said carrier. The clamping device (41) is mounted on the front wall of the carrier. The carrier is connected with a suspension joint (120) and polished rod (110) at the opposite side of the top wheel (30) by a wire rope, through fail safe device (45) extending into said rectangular opening in the upper portion of the post. Counterweights are placed in the carrier, the amount of which depends on the load at the well head side. There are different sizes of counterweights in weights of 3 tons, 2 tons, 1 ton, 0.5 ton and 10 kilograms to ease exact adjustment of the weight of counterweight assembly to ensure that the total weight of counterweight assembly, including that of the fall safe device, is greater, by a weight of one half oil column, than the total weight of the suspension joint and rod string in the oil. Thus, the driving forces required during up and down strokes are both generally equal to a weight of one half the oil column. A force that is generally equal to this load is applied by the electric motor.

Figure 8:
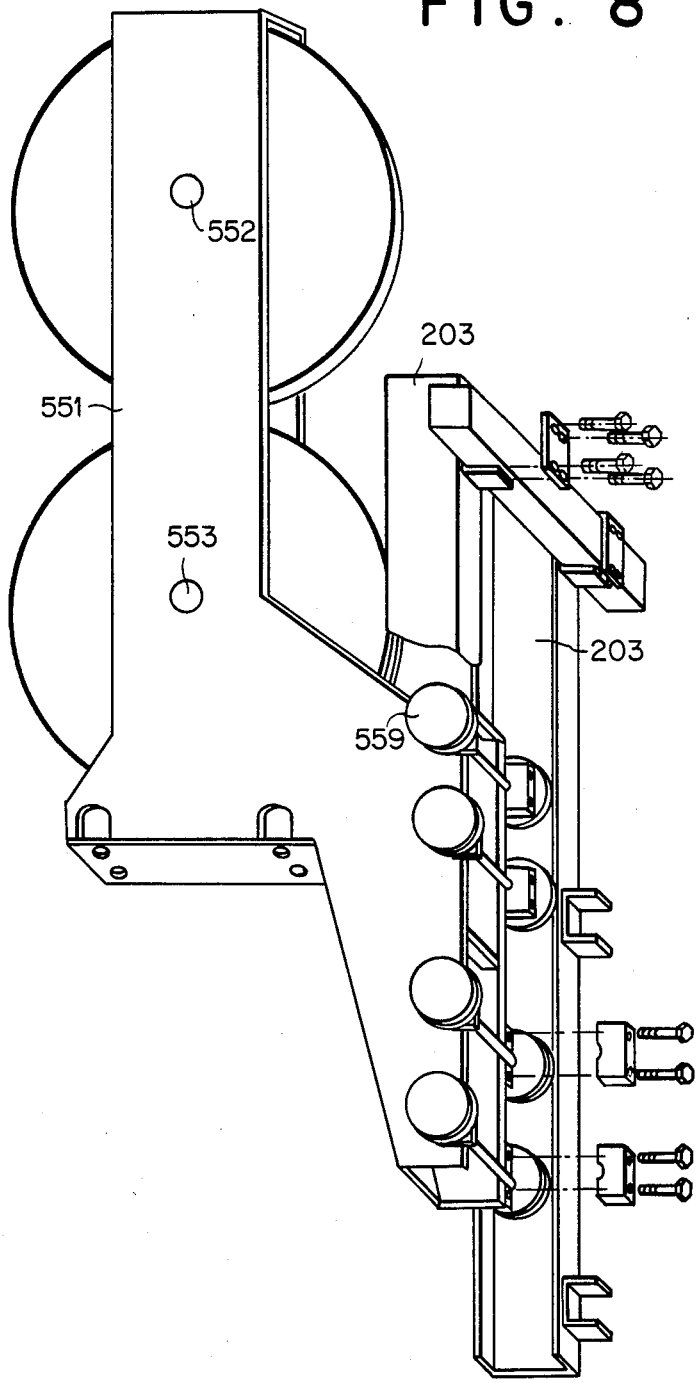
FIG. 8 shows the travelling pulley block assembly in the stroke-multiplying means showed in FIG. 3.
Figure 9:
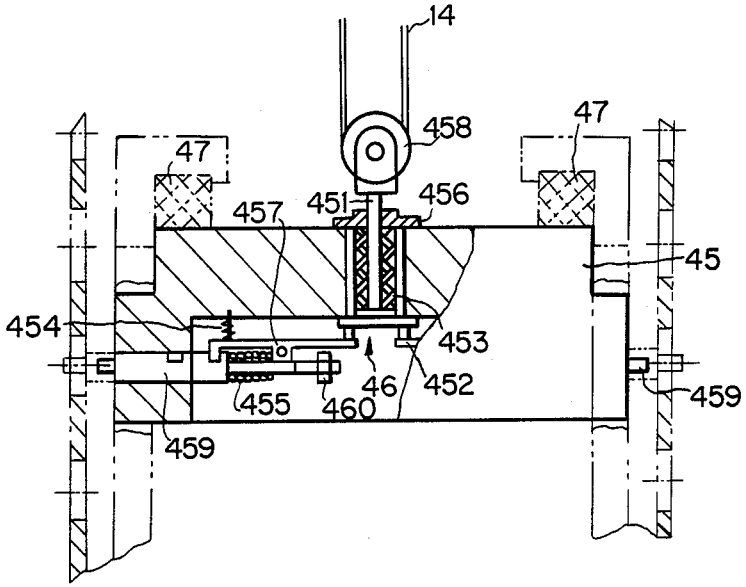
FIG. 9 is the diagrammatic sketch of the safety device mounted on the carrier.

The front track (203) and rear track (202) on the tower are both removable to ease adjustment and repair. The front track is formed of two channels fixed parallel on two front posts of the tower respectively with their openings facing each other as shown in FIG. 8. The rear track is formed of two channels or I-beams fixed on two rear posts of the tower respectively with their webs parallel to each other. There is a row of holes longitudinally arranged in each weld as shown in FIG. 9.

Two sets of fail safe devices are employed in this invention. One of them is installed in the counterweight-polished rod system, and the other one is installed in the stroke-multiplying means. As shown is FIG. 9, the fail safe device (45) installed in the counterweight-polished rod system is located between two posts of the carrier, including a cross beam (451) with a vertical hole in the middle of its top surface, an ejection device (46) for the safety pins installed in the vertical hole and below the cross beam. The cross beam is located between two posts of the carrier with both ends extending into the rectangular openings in the posts respectively. Two rubber blocks (47) of certain thickness are sandwiched between the top face of the cross beam and the top surfaces of said openings, keeping a certain clearance between the top face of said cross beam and the upper surfaces of the rectangular openings in the posts. The ejection device for the safety pins comprises at least two safety pins placed in holes on two side walls of the cross beam, two lever mechanisms controlled by a push rod (451) controlling the ejection of safety pins. The lever mechanism includes springs (454), (455), and a lever (457). The push rod has a means for connecting a pulley at one end and a flange at the other end. The flange is larger in diameter than the vertical hole in the middle of the top face of the cross beam and has a lug (452) extending parallel to the axis of push rod on its outer end face. The end of the push rod (451) without a flange passes upwardly through the vertical hole in the middle of the cross beam. A spring (453) sleeves over the push rod with its one end against the flange and the other end against a cover (456) covering the hole in the middle of the cross beam. The elastic force of spring (453) tends to make the push rod move downward.

A small pulley (458) is pivotally attached to the upper end of said push rod. The wire rope suspended from the top wheel (30) winds round said small pulley (458). Said lug contacts the rear end of the lever (457) which is pivoted at its middle portion to the cross beam and has a dog protruding downward at its front end. In normal operation, the resultant force, which is applied on the rear end of said lever, making said push rod go downwards is far less than that applied by the compression spring (454), keeping the dog in a slot of a safety pin (459). This prevents the safety pin from ejecting and keeps the rear end of the lever in contact with the lug at the lower end of the push rod. The front portion of each safety pin which has a larger diameter is placed in the hole on the side wall of the cross beam and a lateral slot in its rear portion. The axis of said safety pin is aligned with the axis of each hole in the rear track (202) on the tower. There is a thread at the end of a smaller diameter of said safety pin. A compression spring (445) sleeves over the portion of the smaller diameter of the safety pin with its one end against a shoulder in the middle of the safety pin and the other end against the cross beam, tending to make the safety pin eject. A nut (460) screwed on the threaded tail end of said safety pin limits the distance of travelling of the safety pin. A V-shaped slot is on the end face of the front end of the safety pin and should be kept in vertical position when installed.

In normal operation of the pumping unit, the tension in the wire rope passing round the top wheel overcomes the resistance of the spring (453) to keep the flange of push rod (451) in contact with the bottom face of said cross beam. and The spring (454) keeps the dog of lever (457) staying in the lateral slot of safety pin (459), thus making the safety pin in a retracted position. As soon as the tension in the wire rope decreases sharply upon failure of the polished rod or the wire rope, the spring (453) will immediately force the push rod to move downward, which will further activate lever (457), making the dog at its front end go upward to release safety pin (459). Then safety pin (459) will shoot out immediately and insert into one of the holes in the rear track on the tower to prevent the carrier from falling down. The dynamic energy of the carrier is absorbed by rubber dampeners (47). At the same time the power supply of electric motor will be cut off to protect the whole pumping unit. The device used for cutting off power supply is very simple and artful. It includes a wire (480) which is tightened on the inner face of the rear track on the tower and is coincident with the axis of the holes with its upper end fixed and the lower end connected to an interlock switch (not shown). When safety pin (459) shoots out, it will break said wire (480) just before inserting into a hole in the rear track, thus activating the interlock switch to cut off electric current. The V-shaped slot on the safety pin prevents the wire from slipping away.

Another fail safe device functions upon failure or excessive slackness of the wire rope in the stroke-multiplying means to cut off power supply. It includes a stop block (851) which is installed on the sleeve (702) of tensioner (501) or (502) and movable together with said sleeve (702), a switch (852) properly installed on the adjusting screw (707). Upon failure or excessive slackness of the wire rope in the stroke-multiplying means, sleeve (702) will move towards support (708) due to elastic force of spring (705) and the stop block (851) moves together with said sleeve and activates the switch (852) to switch off the current. As described above, the tensioner is capable of keeping the wire rope in the stroke-multiplying means tightened. This is done as follows: if any slight slackness of the wire rope occurs, sleeve (702) moves under the force of the spring in the tensioner, bringing back the wire rope to a tightened condition. Upon failure or excessive slackness of the wire rope, a great displacement of the sleeve will turn the electric switch off provided that the relative position of the stop block and the electric switch (or a device controlling the electric switch) is properly set. The stroke-multiplying means will then stay at the position from where the electric current is about to break. The counterweight-polished rod system also stays in that position because of its approximately balanced characteristic, thus ensuring the safety of the whole unit. Generally speaking, the operator should observe the tightness of the wire rope in the stroke-multiplying means and adjust it whenever necessary before starting the pumping unit and during the operation of the unit. A fail safe device like that described above will stop the pumping unit automatically to ensure safety in case the operator fails to detect such conditions described hereinbefore.

Figure 10:
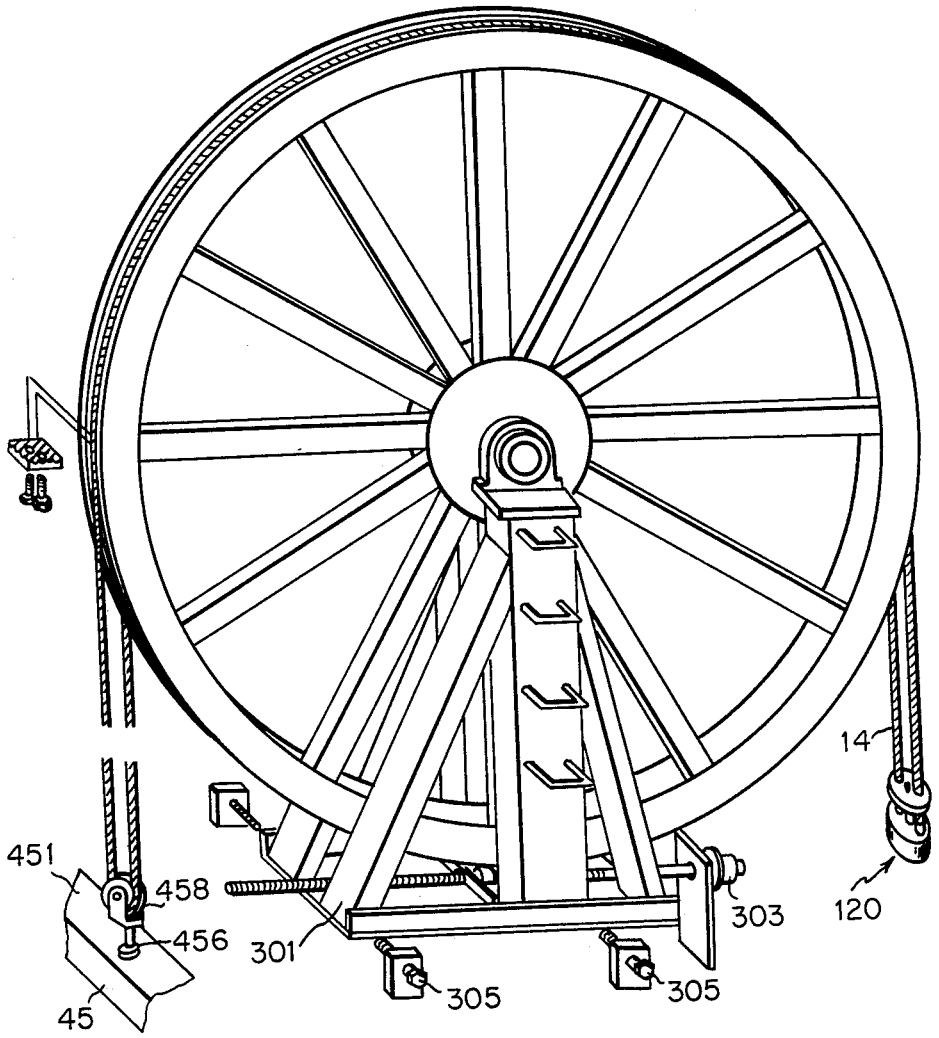
FIG. 10 shows the structure of top wheel.
Figure 11:
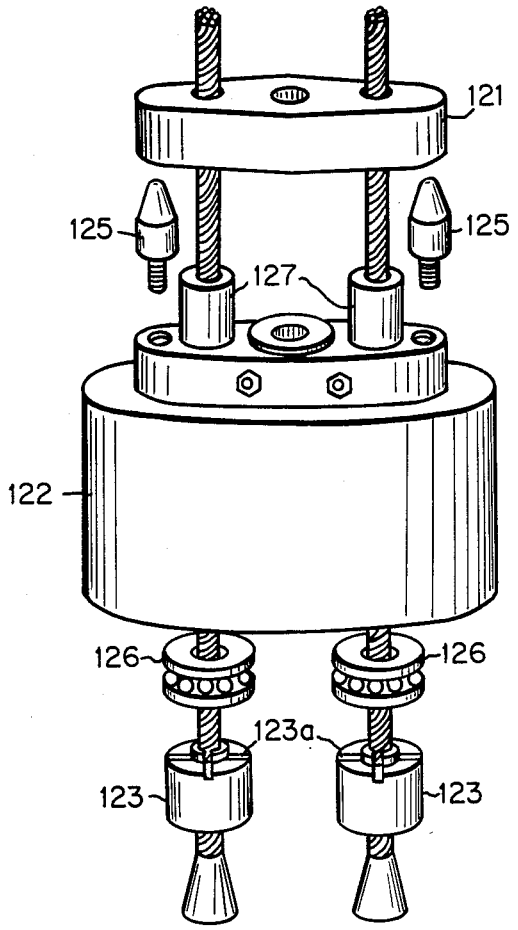
FIG. 11 is the perspective drawing of suspension joint of this invention.

The top wheel (30), as shown is FIG. 10, is a wheel with spokes and is rotatably mounted on a support (301) mounted on a plate on the top of the tower. By means of adjusting screw (303), top wheel (30), together with said support can be moved on the plate back and forth. The position of the top wheel and its support can also be moved to the left or the right by means of a device (305) for fine adjustment. There is a groove around the circumference receiving the wire rope on the periphery of the top wheel and there are several rows of threaded holes on the circumference of the top wheel for fixing a locking plate for the wire rope. A wire rope which connects the carrier with suspension joint and the polished rod passes round the top wheel and is locked at a certain point of the top wheel by a locking plate. Thus when the carrier and the polished rod reciprocate in opposite directions, the top wheel will swing back and forth. The proper position where the locking plate is fixed is such that the locking plate is at the uppermost point of the top wheel at the midpont of the stroke. The suspension joint (120) as shown in FIG. 11 is a flexible coupling between the counterweight assembly and the polished rod, on which a dynamometer can be installed. It includes mainly: an upper body (121) which is flat in shape with a central hole for securing the polished rod and two side hole parallel to said central hole symmetrically located at two sides respectively, a lower body (122) similar in shape to the upper, body but much greater in thickness than the upper body (121), with three holes aligned with those three holes in upper body (121) and two smaller holes on the side face for the dynamometer, two cylindrical sleeves (123), each of which has a tapered longitudinal bore with severl slots extending radially to the periphery on the end face where the diameter of the bore is smaller. The bottoms of the slots slope downward from the center to the periphery to ease discharge of rain waer. The wire rope from the top wheel passes through two side holes in upper body (121) and lower body (122) respectively, then passes through two thrust bearings respectively and then passes through the bores in sleeves (123) from the smaller end to the larger end and is then unstranded at the end and molded with melt zinc to form a truncated cone matching the tapered bore of sleeve (123). Two screws (125) are screwed in the threaded holes on the top face of the lower body, between the upper and lower body. The upper body can be raised by turning screws (125) to facilitate installment of dynamometer. The polished rod passes loosely through the central hole of the lower body and is then secured in the central hole of the upper body. Said zinc heads of wire rope passing loosely through the side holes of the upper and lower bodies go into the tapered bore of sleeve (123). The upper endface of each sleeve contacts with a thrust bearing (126) while the upper endface of the bearing contacts with the lower endface of lower body. Normally the compression force is not taken by screws (125) but by a sleeve (127) sleeving over said polish rod between said upper and lower bodies. When a great resistance in the well is encountered, the downward movement of the polished rod and the upper body attached to it slows down, while the lower body and the wire rope will still move downward at a normal speed, leaving an increased distance between the upper and lower bodies. The lower body is weighted to keep the wire rope tight and to impart a forward moment to the top wheel at all the time. Thus the wire rope in the counterweight-polished rod system is always kept tightened during both up and down strokes even if the downward movement of the polished rod slows down due to a great resistance in the well. This prevents the wire rope from jumping out from the groove of the top wheel or preventing the top wheel from stopping. Slots (123*a*) onsleeve (123) facilitate discharge of rain water etc. to prevent from rust and corrosion of the end of the wire rope. Thrust bearings (126) are used to prevent the suspension joint from inclination due to the twist of wire rope to prevent the polished rod from being unscrewed.

Summing up what has been described above, this invention has a number of advantages, due to its novel and unique design, as follows:

1. It is easy to obtain a long stroke distance as required and to realize desired approximately simple harmonic motion, thus favourable to bring about desired working manner of long stroke distance, low stroke rate, low acceleration, high pump efficiency, high production rate especially suitable for high volume production of deep wells, wells producing viscous oil and oil of high water-oil ratio.

2. Tough structure and reliable operation due to purely mechanical transmission.

3. Smooth reversing of motion and low dynamic load due to the approximately simple harmonic motion of the polished rod.

4. Simple structure, easy adjustment, service and manufacture, low cost and high reliability.

5. Minimum base requirement resulting from the fact that the gear reducer is installed under the tower.

6. Absence of centrifugal force caused by rotating counterweight. All vertical load condition except for a small horizontal force component generated by crank mechanism.

7. The advantages listed above make the pumping unit in this invention not only suitable for wells on land but also for those offshore.

What is claimed is:

1. A pumping unit comprising:

(a) a base;

(b) tower means positioned upon said base;

(c) motor means positioned upon said base;

(d) gear reducing means connected to said motor with output shaft protruding from the sides of the tower means to adjust the output of the motor;

(e) linear reciprocating movement generating means operatively associated with said gear reducing means for generating linear reciprocating movement, which comprises a pair of crank mechanisms connected to said output shaft;

(f) linear movement distance increasing means capable of transmitting power bi-directionally operatively associated with said reciprocating linear movement generating means which comprises a fixed pulley block assembly and a travelling pulley block assembly and a first fail safe means;

(g) means for balancing an elongated member, said balancing means comprising counterweight assembly means with a polished-rod system and a second fail safe means; and (h) means for transmitting the linear reciprocating movement to said elongated member, said transmitting means comprising a rotatable wheel which may swing back and forth by a limited angle displacement in response to said reciprocating movement.

2. The pumping unit of claim 1 wherein said linear movement distance increasing means comprises a first wire rope interconnecting at least some of said pulleys of said fixed and travelling pulley block assemblies, said first wire rope being connected by its two ends to the fixed pulley block assembly and being secured by the first fail safe means.

3. The pumping unit of claim 2 wherein said fixed pulley block assembly comprises a lower and an upper pulley block and each pulley of said fixed pulley blocks is independently rotatable about its axis.

4. The pumping unit of claim 3 wherein said travelling pulley block assembly is movable up and down between said fixed upper and lower pulley block assemblies along a track mounted on said tower and each pulley of said travelling pulley block assembly is independently rotatable about its axis.

5. The pumping unit of claim 4 wherein said rotatable wheel is mounted on the top of said tower means and operatively associated with a second wire rope, said second wire rope connected at one end to said elongated member and clamped at its other end to said linear movement distance increasing means through said balancing means.

6. The pumping unit of claim 5 wherein said counterweight assembly is a self-closed box-formed device and connected with the counterweight polished-rod system through a clamping device.

7. The pumping unit of claim 6 wherein said two fail safe means are capable of keeping said balancing means in a final position and of stopping said pumping unit upon failure of said elongated member or either of said wire ropes.

8. A long stroke pumping unit comprising:

(a) a base;

(b) an upright tower means positioned on said base;

(c) multi-speed motor means positioned on said base;

(d) gear reducer means which comprises an output shaft protruding from the sides of said tower means, which adjusts the output from said motor means;

(e) linear reciprocating movement generating means operatively associated with said gear reducing means, which comprises an overarm connected to a travelling pulley block assembly, a pair of connecting rods each of them connected at one end to one end of said overarm respectively, and a pair of crank means each of them connected at one end to the other end of one of said connecting rods respectively, and connected at the other ends to the ends of said output shaft of said gear reducing means;

(f) stroke-multiplying means operatively associated with said linear reciprocating movement generating means, which comprises fixed lower and upper pulley blocks and travelling pulley block assembly interconnected by a first wire rope and secured by a first fail safe device and which amplifies the linear movement distance;

(g) balancing means which comprises a counterweight assembly, a second fail safe device; and (h) linear reciprocating movement transmitting means which comprises a wheel operatively associated with a second wire rope which is connected at one end with an elongated member and clamped at its other end with said balancing means by said second fail safe device, wherein said balancing means being connected with said stroke-multiplying means by a clamping means.

9. The long stroke pumping unit of claim 8 wherein at least some of the pulleys of said fixed lower and upper pulley blocks and said travelling pulley block assemblies are interconnected by said first wire rope.

10. The long stroke pumping unit of claim 9 wherein each of said fixed lower and upper pulley blocks comprises means for attachment to said tower means, a shaft positioned on said attachment means, and a large rotatable pulley and a small rotatable pulley both positioned on said shaft.

11. The long stroke pumping unit of claim 10 wherein said travelling pulley block assembly comprises a frame and two shafts positioned on said frame, said travelling pulley block assembly being movable up and down between said fixed upper and lower pulley blocks.

12. The long stroke pumping unit of claim 11 wherein said first wire rope is wound around all pulleys without crossing over itself with one end of said first wire rope secured to said base and the other end of said first wire rope wound around a pulley on the lower shaft of said traveling pulley block and around various other pulleys in said fixed and traveling pulley block, and connected to a location on said tower means.

13. The long stroke pumping unit of claim 12 wherein said counterweight assembly includes a rectangular box mounted on rollers and a track attached to said tower means for rolling movement of said counterweight assembly.

14. The long stroke pumping unit of claim 13 wherein said second fail safe means in said counterweight assembly comprises an ejection device which ejects safety pins in said counterweight assembly, thereby keeping said balancing means from falling down and simultaneously cutting off the output from said output shaft and said first fail safe means in said stroke-multiplying means comprises an automatic system which cuts off the output from said output shaft upon failure or slackness of said first wire rope in said stroke-multiplying means.

* * * * *